US010258529B2

(12) United States Patent
Schem

(10) Patent No.: US 10,258,529 B2
(45) Date of Patent: Apr. 16, 2019

(54) CASKET TRANSPORT AND LOWERING DEVICE SYSTEM

(71) Applicant: THE UNITED STATES OF AMERICA AS REPRESENTED BY THE DEPARTMENT OF VETERANS AFFAIRS, Washington, DC (US)

(72) Inventor: Clifford Schem, Pleasanton, CA (US)

(73) Assignee: THE UNITED STATES OF AMERICA AS REPRESENTED BY THE DEPARTMENT OF VETERANS AFFAIRS, Washington, DC (US)

( * ) Notice: Subject to any disclaimer, the term of this patent is extended or adjusted under 35 U.S.C. 154(b) by 0 days.

(21) Appl. No.: 16/040,370

(22) Filed: Jul. 19, 2018

(65) Prior Publication Data

US 2018/0318163 A1 Nov. 8, 2018

Related U.S. Application Data

(62) Division of application No. 15/816,978, filed on Nov. 17, 2017.

(60) Provisional application No. 62/423,865, filed on Nov. 18, 2016.

(51) Int. Cl.
*A61G 19/00* (2006.01)
*A61G 21/00* (2006.01)

(52) U.S. Cl.
CPC ..... *A61G 19/00* (2013.01); *A61G 21/00* (2013.01)

(58) Field of Classification Search
CPC ..... A61G 19/00
See application file for complete search history.

(56) References Cited

U.S. PATENT DOCUMENTS

| | | | | |
|---|---|---|---|---|
| 579,806 | A | 3/1897 | Richmond | |
| 1,868,796 | A * | 7/1932 | Harder | A61G 19/00 27/32 |
| 3,019,920 | A * | 2/1962 | Hillenbrand | A61G 21/00 414/531 |
| 3,372,819 | A | 3/1968 | Kellog | |
| 6,419,440 | B1 | 7/2002 | Smith | |

* cited by examiner

*Primary Examiner* — James A Shriver, II
*Assistant Examiner* — James J Triggs
(74) *Attorney, Agent, or Firm* — Procopio, Cory, Hargreaves & Savitch LLP

(57) ABSTRACT

A casket transport and lowering device system is presented. The system includes a transportable frame with extendable rails configured to rotate and extend out over a gravesite. The extendable rails may also include an end rail and one or more extendable feet. The transportable frame may also be protected inside an exterior housing. The system also includes a carriage that rolls along the extendable rails into a position directly over the top of the gravesite. The carriage supports a lowering device upon which the casket rests. When the carriage is positioned over the gravesite, the lowering device is also positioned to lower the casket into the grave.

20 Claims, 9 Drawing Sheets

CASKET TRANSPORT AND LOWERING DEVICE SYSTEM

RELATED APPLICATION

The present application claims priority to U.S. provisional patent application No. 62/423,865 filed 18 Nov. 2016, which is incorporated herein by reference in its entirety.

BACKGROUND

Field of the Invention

The present invention generally relates to burial service technology and more specifically relates to casket transport and lowering of the casket into the gravesite.

Related Art

Conventional solutions for transporting a casket to the burial site and lowering the casket into the ground require at least four people to accomplish the task. Using conventional solutions, the casket is transported by vehicle to a location near the gravesite and a metal frame with substantial ground supports is placed over the gravesite. Subsequently, a conventional and commercially available lowering device supporting the casket is manually carried from the transport vehicle and positioned on top of the metal frame. The casket is then removed from the transport vehicle and manually carried to the gravesite and placed on top of the lowering device. These manual steps require at least four people to safely perform and are therefore very costly and time consuming and these manual steps expose personnel to substantial risk of injury. Accordingly, what is needed is a system and method that overcomes the significant problems found in the conventional solutions described above.

SUMMARY

A casket transport vehicle includes a casket transport and lowering device system comprising a housing and a fixed frame having fixed rails and a carriage. The fixed frame rests upon a rotating frame member to allow the entire frame and housing combination to rotate on the transport vehicle. The fixed frame has fixed rails on which the carriage rests. The carriage supports a conventional and commercially available casket lowering device, which in turn supports a casket. The casket transport vehicle transports the casket transport and lowering device system to the gravesite and the casket transport vehicle is positioned near a short side of the gravesite. The casket transport and lowering device system is rotated so the position of the casket within the casket transport vehicle is in line with the gravesite. The doors to the housing are opened and the proximal ends of two extension rails are attached to the fixed rails of the fixed frame. A frame end is attached to the distal ends of the two extension rails and variable length feet are extended down from the frame end such that feet at the bottom of the variable length extendable portion engage the surface of the ground. When the two extension rails and frame end are secured in place, the two extension rails extend parallel to the long sides of the gravesite and the extension end is parallel to the short side of the gravesite that is furthest away from the transport vehicle. Accordingly, when the extension rails and frame end are secured in place, the carriage, with the conventional and commercially available lowering device with casket on top, can be moved out from the casket transport vehicle and positioned directly over the gravesite.

The carriage includes vertical and horizontal casters that allow the carriage to roll along the fixed frame and the extension rails to the frame end. In one embodiment, a motor is used to propel the carriage along the fixed frame and the extension rails to the frame end. Alternatively, they carriage may be manually moved along the fixed frame and the extension rails to the frame end. In one embodiment, the extension rails are extended out over the gravesite by way of securing the extension rails and frame end in place. In an alternative embodiment, the extension rails are extended out over the gravesite by way of a motor that cantilevers the extension rails out from the transport vehicle. The carriage is rolled out over the gravesite by rolling its vertical and horizontal casters along the fixed frame rails and the extension frame rails. Advantageously, this can be accomplished by a single person. The lowering device that rests upon the carriage and supports the casket subsequently performs the function of lowering the casket into the ground.

Other features and advantages of the present invention will become more readily apparent to those of ordinary skill in the art after reviewing the following detailed description and accompanying drawings.

BRIEF DESCRIPTION OF THE DRAWINGS

The structure and operation of the present invention will be understood from a review of the following detailed description and the accompanying drawings in which like reference numerals refer to like parts and in which.

DETAILED DESCRIPTION

Embodiments disclosed herein describe a casket transport and lowering device system. The system includes a transportable frame with extendable rails configured to extend out over a gravesite. The system also includes a carriage that rolls along the extendable rails into a position directly over the top of the gravesite. The carriage supports a lowering device upon which the casket rests. When the carriage is positioned over the gravesite, the lowering device is also positioned to lower the casket into the grave. After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention as set forth in the appended claims.

Figure 1:
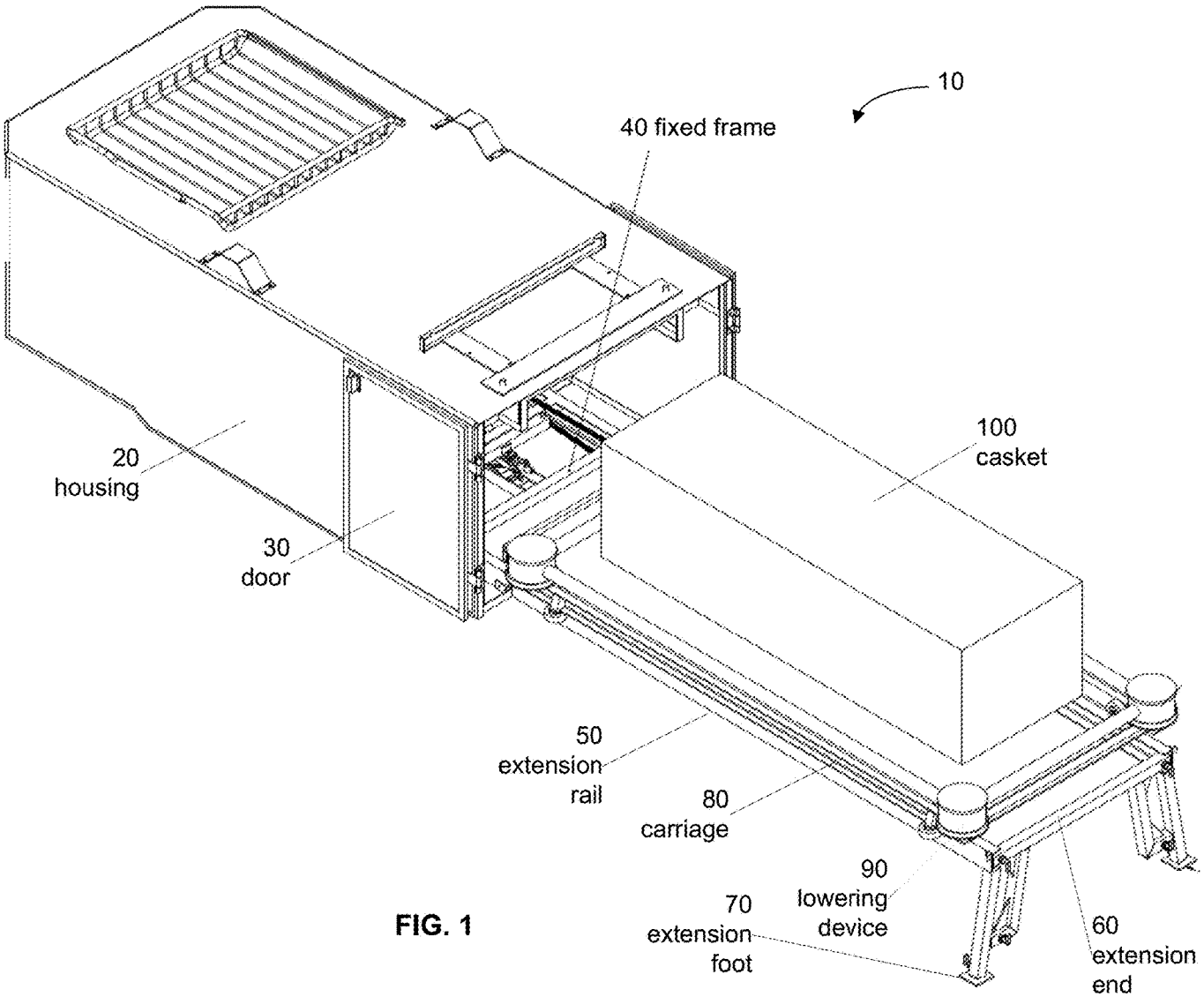
FIG. 1 is a perspective view diagram illustrating an example casket transport and lowering device system according to an embodiment of the invention.

FIG. 1 is a network diagram illustrating an example casket transport and lowering device system 10 according to an embodiment of the invention. In the illustrated embodiment, the system 10 comprises a housing 20 that may include one or more optional doors 30 that may swing or roll open to expose the interior of the housing. The system 10 comprises a fixed frame 40. A carriage 80 rests on the fixed frame and is configured to roll along the rails of the fixed frame 40 and move out of the housing 20 onto extension rails 50 that may be supported by an extension end 60 having one or more extension feet 70. The carriage 80 supports a lowering device 90 upon which a casket 100 is positioned.

When deployed, the system 10 is secured to a transport vehicle (not shown). The transport vehicle moves the system 10 to a position adjacent the gravesite and the fixed frame and housing can rotate on a rotating frame member (not shown) to align the casket 100 with the gravesite. The doors 30 of the housing 20 are opened and the extension rails 50 are electronically extended out from the fixed frame 40. In one embodiment, the extension rails 50 may be manually connected to the fixed frame 40. One or more extension feet 70 are extended down from the extension end 60 that is located at the distal end of the extension rails 50. The extension feet 70 are variable length in order to support the extension rails and the weight of the carriage and its payload while also allowing the extension rails to remain parallel to each other and in alignment with the corresponding rails of the fixed frame 40. Once the extension rails are in position on each side of the gravesite, the carriage is rolled along the rails of the fixed frame 40 and out onto the extension rails 50 to position the carriage 80 and the lowering device 90 and the casket 100 directly above the gravesite. Once the carriage 80 and its payload (casket) are in position, the lowering device 90 can perform its function of lowering the casket 100 into the gravesite.

Figure 2:
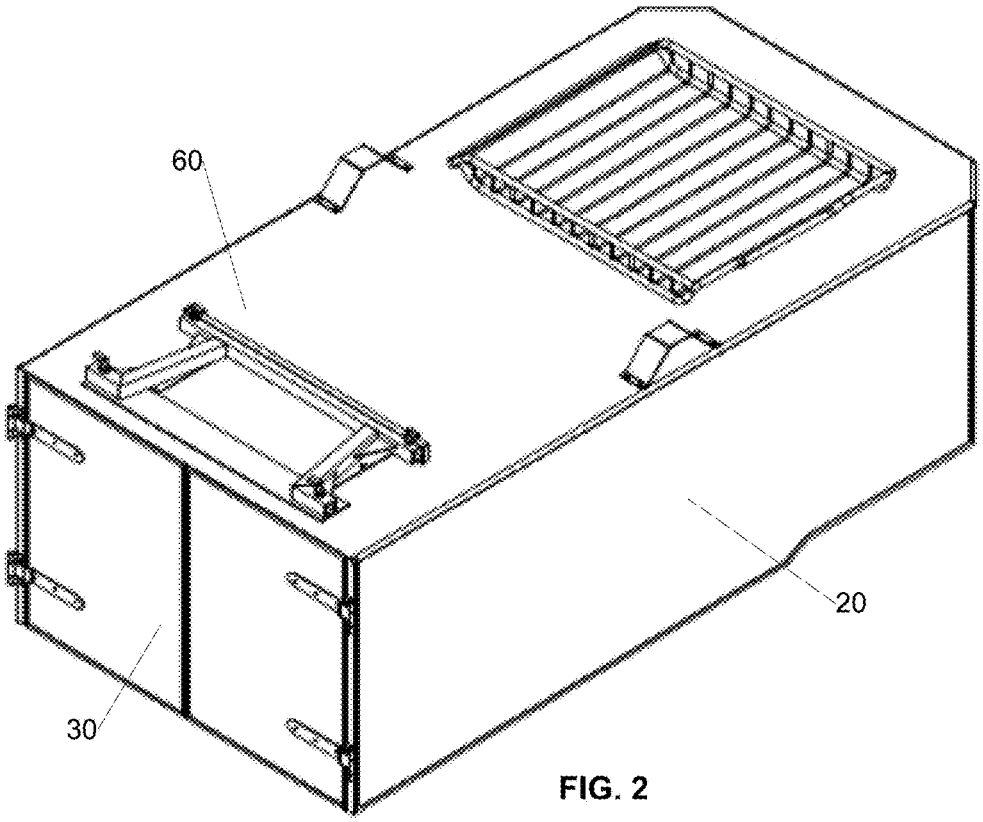
FIG. 2 is a block diagram illustrating an example housing according to an embodiment of the invention.

FIG. 2 is a block diagram illustrating an example housing 20 according to an embodiment of the invention. In the illustrated embodiment, the housing 20 includes two doors 30 that are configured to swing open to expose the interior of the housing where the carriage rests on the fixed frame 40. Additionally, secured to the roof of the housing 20 is the extension end 60. In one embodiment, the extension end 60 and the extension rails 50 are manually connected to the fixed frame 40 once the transport vehicle has positioned the system 10 adjacent the gravesite. In such an embodiment, the extension rails 50 may be secured during transport to the roof of the housing 20 as illustrated for the extension end 60 or the extension rails 50 may be secured during transport inside the housing 20, for example in an upper corner where they are easily accessible.

In an alternative embodiment, the fixed frame 40 may electronically extend the extension rails 50 out over the gravesite and the extension feet 70 may be locked in an upward direction during transport to prevent movement of the carriage during transport and then moved downward into position to support the extension rails 50 during use.

Figure 3:
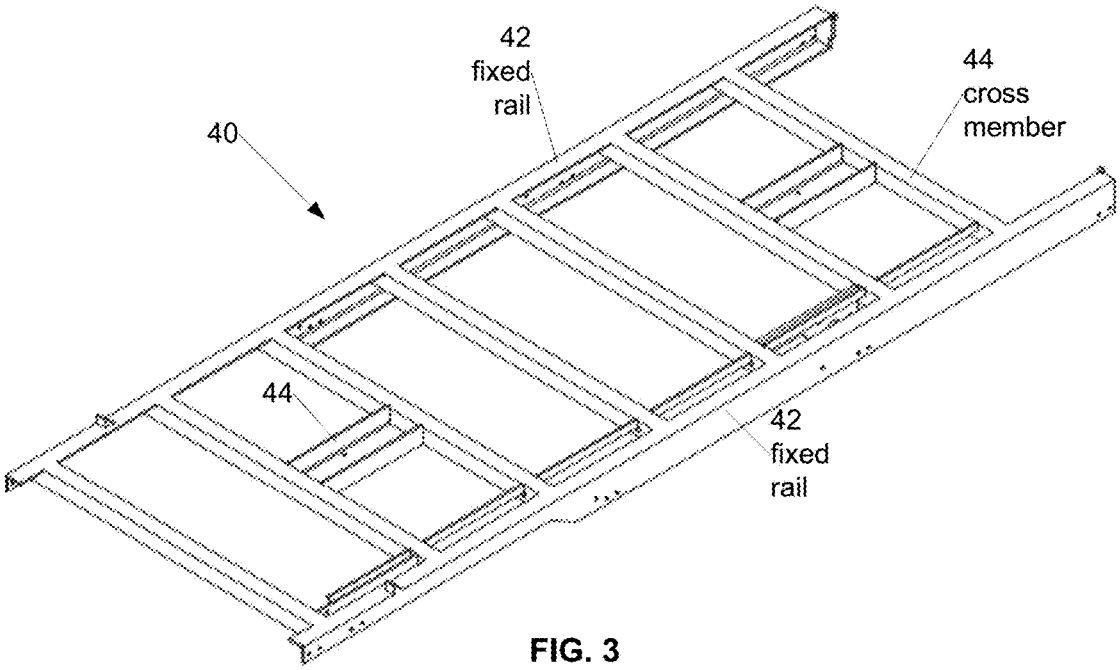
FIG. 3 is a block diagram illustrating an example fixed frame with fixed rails according to an embodiment of the invention.

FIG. 3 is a block diagram illustrating an example fixed frame 40 with fixed rails 42 according to an embodiment of the invention. In the illustrated embodiment, the fixed frame 40 comprises two fixed rails 42 on opposite sides of the fixed frame 40. A plurality of cross members 44 provide structural support to the fixed frame 40. Each of the fixed rails 42 preferably have a top surface and a side surface that are configured to provide a flat surface along which a caster of the carriage may roll. Accordingly, the two top surfaces are substantially parallel to each other and the two side surfaces are substantially parallel to each other. The top surfaces support the weight of the carriage and its payload while the side surfaces prevent the carriage and its payload from undesirable lateral movement during transport and movement out onto the extension rails for positioning the lowering device and the casket over the gravesite.

Figure 4:
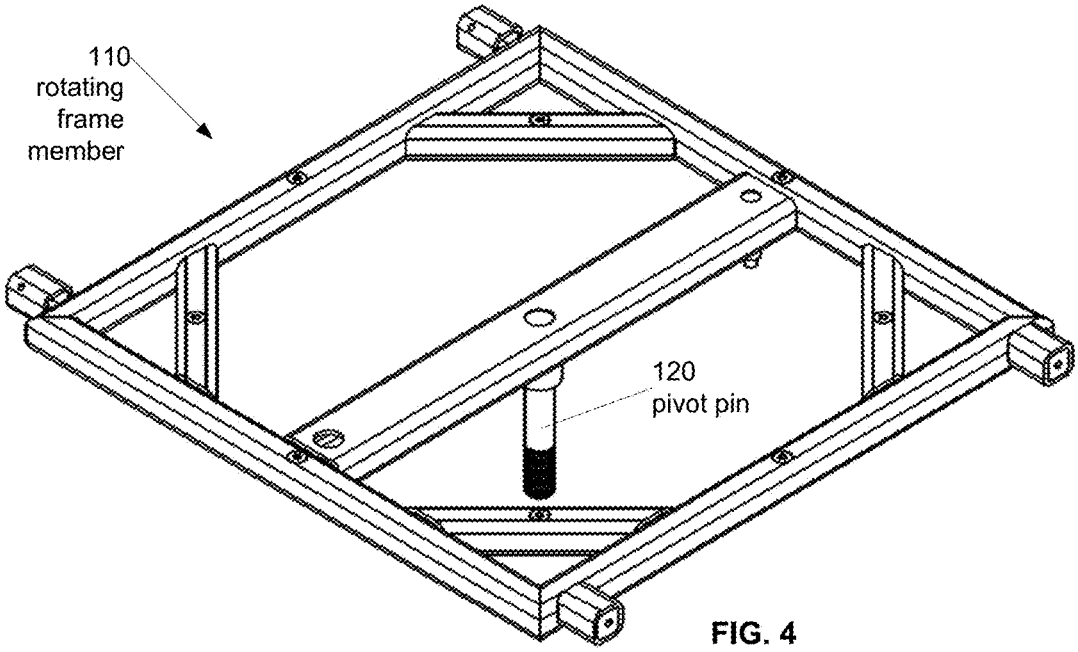
FIG. 4 is a block diagram illustrating an example rotating frame member according to an embodiment of the invention.
Figure 5:
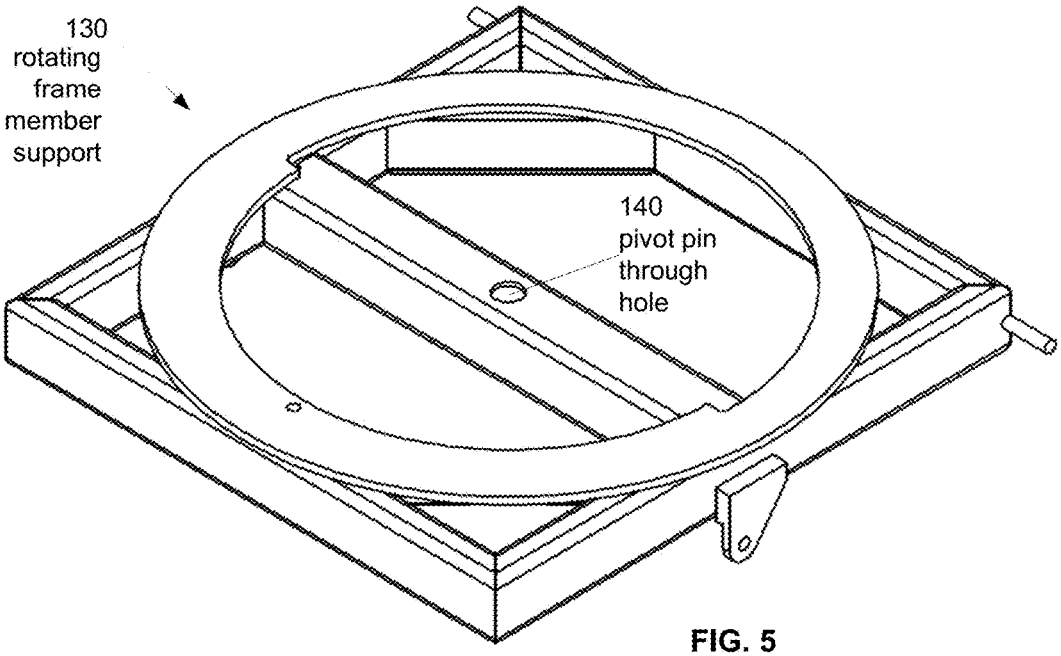
FIG. 5 is a block diagram illustrating an example rotating frame member support according to an embodiment of the invention.

FIG. 4 is a block diagram illustrating an example rotating frame member 110 according to an embodiment of the invention and FIG. 5 is a block diagram illustrating an example rotating frame member support 130 according to an embodiment of the invention. In FIGS. 4-5, the rotating frame member 110 comprises a pivot pin 120. The rotating frame member 110 is configured to engage one or more lower surfaces of the fixed frame 40 on a top side of the rotating frame member 110. The rotating frame member 110 is also configured to engage a rotating frame member support 130, for example by way of the pivot pin 120 being threaded into a pivot point through hole 140 of the rotating frame member support 130. The rotating frame member 110 may also engage an upper surface of the rotating frame member support 130 on a bottom side of the rotating frame member 110 to provide additional support for the fixed frame 40 and its payload.

Figure 6:
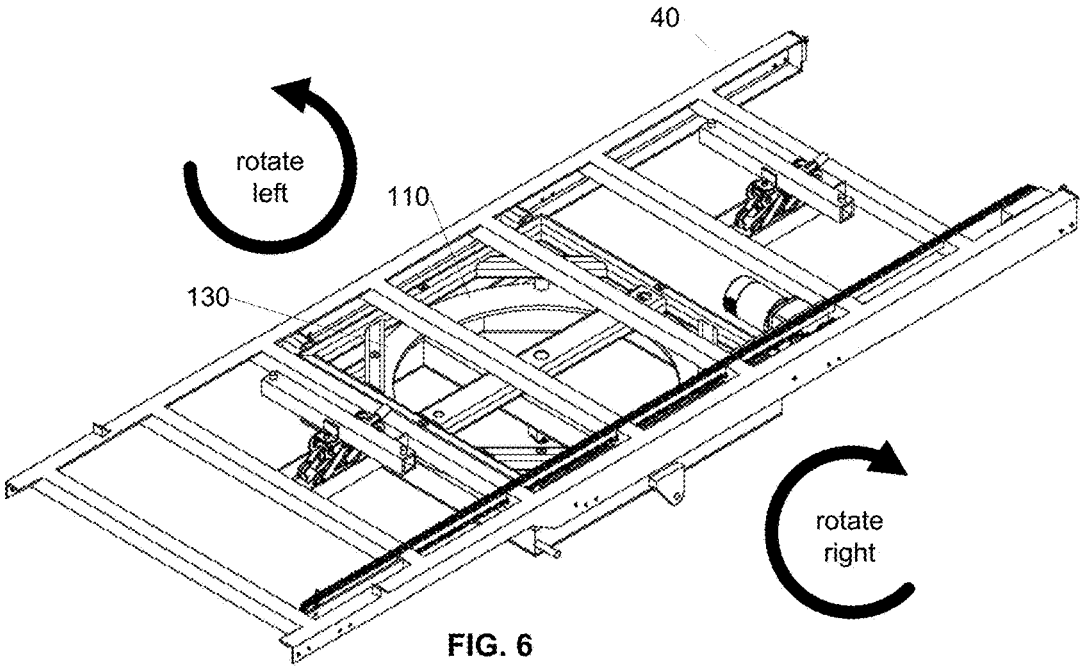
FIG. 6 is a perspective view diagram illustrating an example fixed frame mounted on a rotating frame member and rotating frame member support according to an embodiment of the invention.

FIG. 6 is a perspective view diagram illustrating an example fixed frame 40 mounted on a rotating frame member 110 and rotating frame member support 130 according to an embodiment of the invention. In the illustrated embodiment, the rotating frame member 110 is configured to rotate at least 90 degrees clockwise or counterclockwise to allow the fixed frame 40 to rotate into a position where the casket is in alignment with the gravesite. In one embodiment, the rotating frame member 110 is rotated manually by an operator. In an alternative embodiment, the rotating frame member 110 is rotated under control of a motor.

Figure 7:
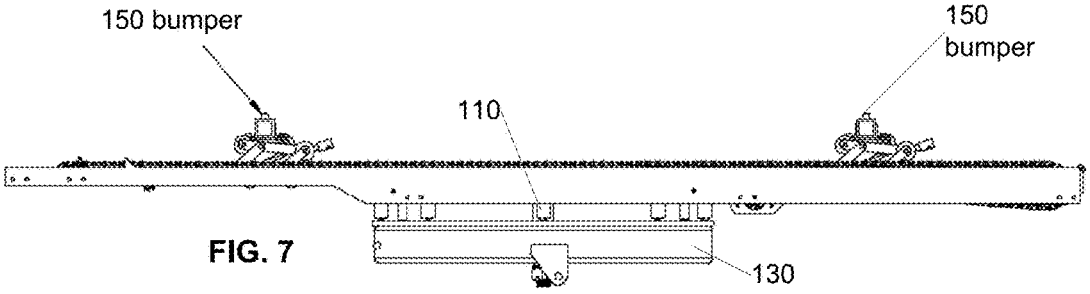
FIG. 7 is a side view diagram illustrating an example fixed frame mounted on a rotating frame member and rotating frame member support according to an embodiment of the invention.

FIG. 7 is a side view diagram illustrating an example fixed frame 40 mounted on a rotating frame member 110 and rotating frame member support 130 according to an embodiment of the invention. In the illustrated embodiment, the fixed frame 40 comprises two bumpers 150 that provide additional support for the payload (casket) of the carriage 80 when the carriage is in the housing 20, ready for transport or when the carriage is moving along the fixed rails 42 of the fixed frame 40.

Figure 8:
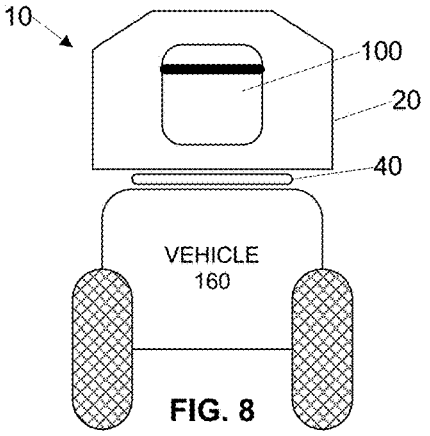
FIG. 8 is a block diagram illustrating an example casket transport and lowering device system in a first orientation according to an embodiment of the invention.

FIG. 8 is a block diagram illustrating an example casket transport and lowering device system 10 in a first orientation according to an embodiment of the invention. In the illustrated embodiment, the housing 20, fixed frame 40 and the casket 100 are shown unconnected to simplify the discussion of their combined function. Specifically, the transport vehicle 160 transports the casket 100 a position adjacent the gravesite. At the position adjacent the gravesite, the fixed frame 40 rotates to align the casket 100 with the gravesite. In the illustrated embodiment, the fixed frame 40 has positioned the casket 100 so that it is orthogonal to the axles of the transport vehicle 160.

Figure 9:
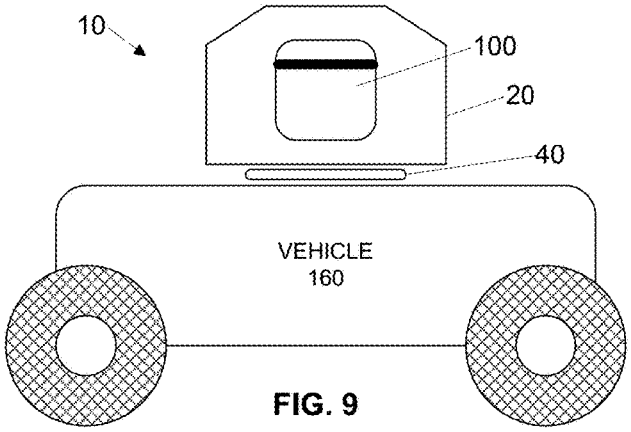
FIG. 9 is a block diagram illustrating an example casket transport and lowering device system in a second orientation according to an embodiment of the invention.

FIG. 9 is a block diagram illustrating an example casket transport and lowering device system 10 in a second orientation according to an embodiment of the invention. In the illustrated embodiment, the housing 20, fixed frame 40 and the casket 100 are shown unconnected to simplify the discussion of their combined function. Specifically, the transport vehicle 160 transports the casket 100 a position adjacent the gravesite. At the position adjacent the gravesite, the fixed frame 40 rotates to align the casket 100 with the gravesite. In the illustrated embodiment, the fixed frame 40 has positioned the casket 100 so that it is parallel to the axles of the transport vehicle 160.

Figure 10:
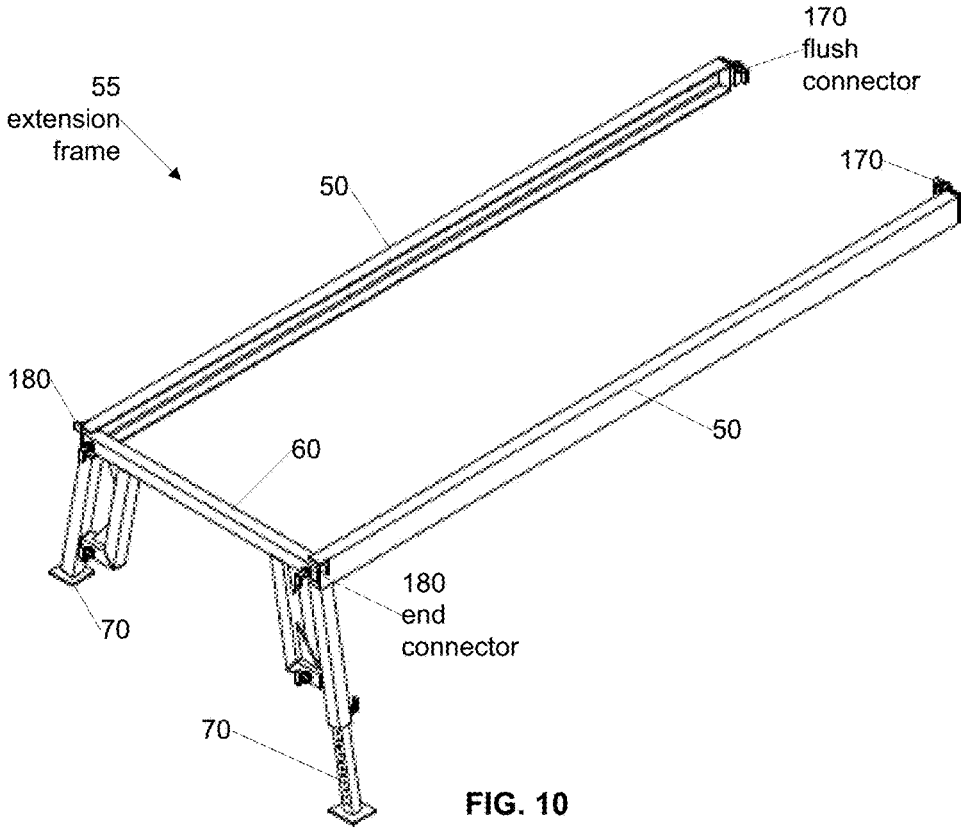
FIG. 10 is a perspective view diagram illustrating an example extension frame including extension frame rails and an extension frame end and two extension feet according to an embodiment of the invention.

FIG. 10 is a perspective view diagram illustrating an example extension frame 55 including extension frame rails 50 and an extension frame end 60 and two extension feet 70 according to an embodiment of the invention. In the illustrated embodiment, the extension frame 55 comprises two extension rails 50 and an extension end 60 having two extension feet 70. The extension rails 50 each comprise at their proximal ends nearest the fixed frame 40 a flush connector 170. The flush connector 170 is configured to connect the extension rail 50 to the fixed rail 42 of the fixed frame 40 in a fashion that allows the casters of the carriage 80 to smoothly roll from the fixed frame 40 onto the extension frame 55. Additionally, the extension rails 50 each comprise at their distal ends furthest from the fixed frame 40 an end connector 180. The end connector 180 is configured to connect the extension rail 50 to the extension end 60 in a fashion that allows the extension rails 50 to remain parallel to each other and aligned with the fixed rails 42 of the fixed frame 40. The extension end 60 also includes two extension feet 70 that are each variable in length to facilitate secure and parallel support of the extension rails 50.

In one embodiment, in order to extend the frame system comprising the fixed frame 40 portion and the extension frame 55 portion, the extension frame rails 50 are manually connected to the fixed frame rails using the flush connectors 170. In an alternative embodiment, in order to extend the frame system comprising the fixed frame 40 portion and the extension frame 55 portion, the extension frame rails 50 are cantilevered out from the fixed frame 40 portion and the flush connectors 170 provide a transition section for the wheels of the carriage to smoothly transition from the fixed frame 40 portion of the frame system to the extension frame 55 portion of the frame system. The extension frame rails 50 may be cantilevered out manually or under control of a motor. The extension end 60 is optional when the extension frame rails 50 are cantilevered out, depending on the strength of the frame system and the weight of the carriage 80 and its combined payload (e.g., the lowering device and casket).

Figure 11:
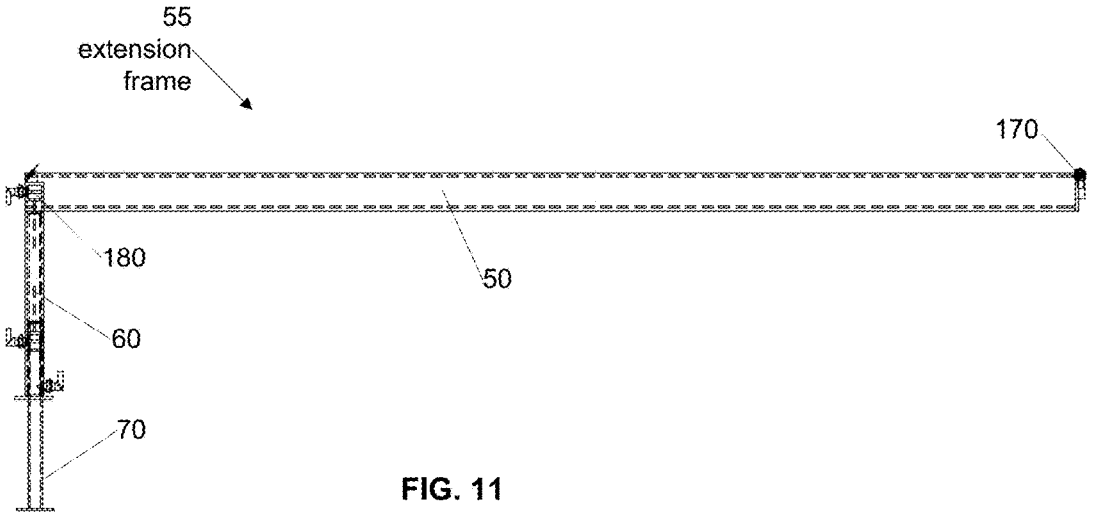
FIG. 11 is a side view diagram illustrating an example extension frame including extension frame rails and an extension frame end and two extension feet according to an embodiment of the invention.

FIG. 11 is a side view diagram illustrating an example extension frame 55 including extension frame rails 50 and an extension frame end 60 according to an embodiment of the invention. In the illustrated embodiment, the extension end 60 extends down from the extension rail 50 at substantially a 90 degree angle. Advantageously, this provides substantial support for the carriage 80 and its payload when the carriage 80 is rolled out onto the extension frame 55. Additionally, while the extension end 60 may be 90 degrees with respect to the extension rails 50, the extension feet 70 may be parallel to each other, or they may be at an angle to each other as shown in FIG. 10. Alternative angles for the extension end 60 and the extension feet 70 may also be employed as will be understood by the skilled artisan.

Figure 12:
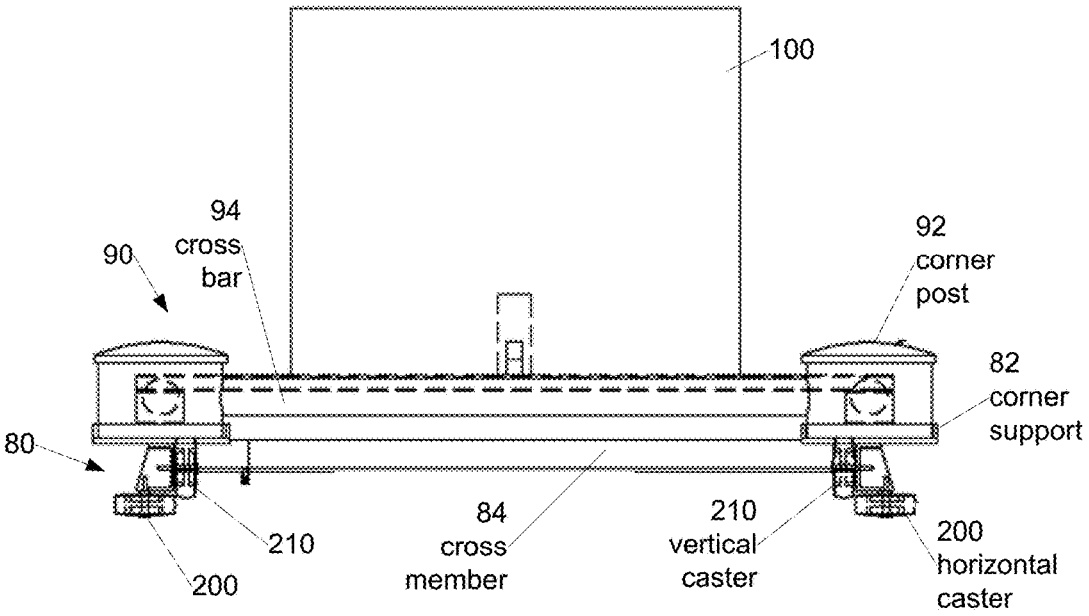
FIG. 12 is an end view diagram illustrating an example carriage supporting a lowering device according to an embodiment of the invention.

FIG. 12 is an end view diagram illustrating an example carriage 80 supporting a lowering device 90 and casket 100 according to an embodiment of the invention. In the illustrated embodiment, the carriage 80 includes corner supports 82 that comprise a flat surface and a partial or complete rail extending upward from the flat surface. The flat surface of the corner support 82 is configured to support the corner posts 92 of the lowering device 90. The rail of the corner support 82 is configured to prevent undesirable sliding of the lowering device 90 when it is resting on the carriage 80. Although the end view diagram only shows two corner supports 82, the carriage 80 comprises at least three or more corner supports 82. Because conventional lowering devices 90 typically have four corner posts 92 that are connected by four cross bars 94, the carriage 80 typically has four corner supports 82.

The carriage 80 also includes two or more sets of casters. In the illustrated embodiment, a set of casters comprises a horizontal caster 200 and a vertical caster 210. The horizontal casters 200 are configured to engage an outer surface of the fixed rails 42 of the frame 40 and an outer surface of the extension rails 50 of the extension frame 55. Advantageously, opposing horizontal casters 200 prevent horizontal movement of the carriage 80 during transport and during deployment when the carriage 80 is rolled out onto the extension frame 55. The vertical casters 210 are configured to engage an upper surface of the fixed rails 42 of the frame 40 and an upper surface of the extension rails 50 of the extension frame 55. Advantageously, the vertical casters 210 support the weight of the carriage 80 and its payload and the vertical casters 210 allow the carriage to roll out from the fixed frame 40 onto the extension frame 55 and over the gravesite.

Figure 13:
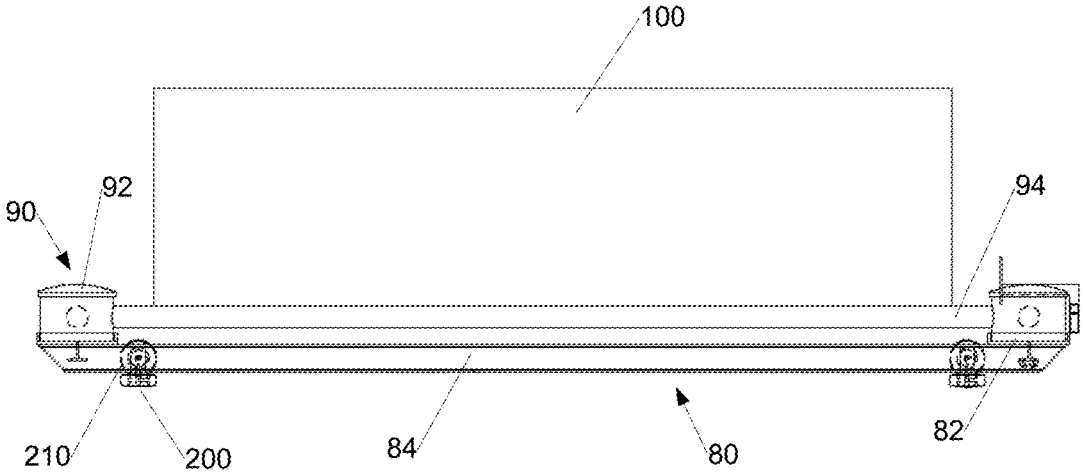
FIG. 13 is a side view diagram illustrating an example carriage supporting a lowering device according to an embodiment of the invention.

FIG. 13 is a side view diagram illustrating an example carriage 80 supporting a lowering device 90 and a casket 100 according to an embodiment of the invention. In one embodiment, the carriage 80 comprises four corner supports 82 that are connected by four cross members 84. In this embodiment, the carriage 80 also includes four sets of casters, with each set including a horizontal caster 200 and a vertical caster 210. Advantageously, the configuration of the carriage 80 in this embodiment, defines an internal opening through which the lowering device 90 can lower the casket 100 into the gravesite. Additionally, the configuration of the carriage 80 in this embodiment fully supports the lowering device 90, which includes four corner posts 92 that are connected by four cross bars 94.

Figure 14:
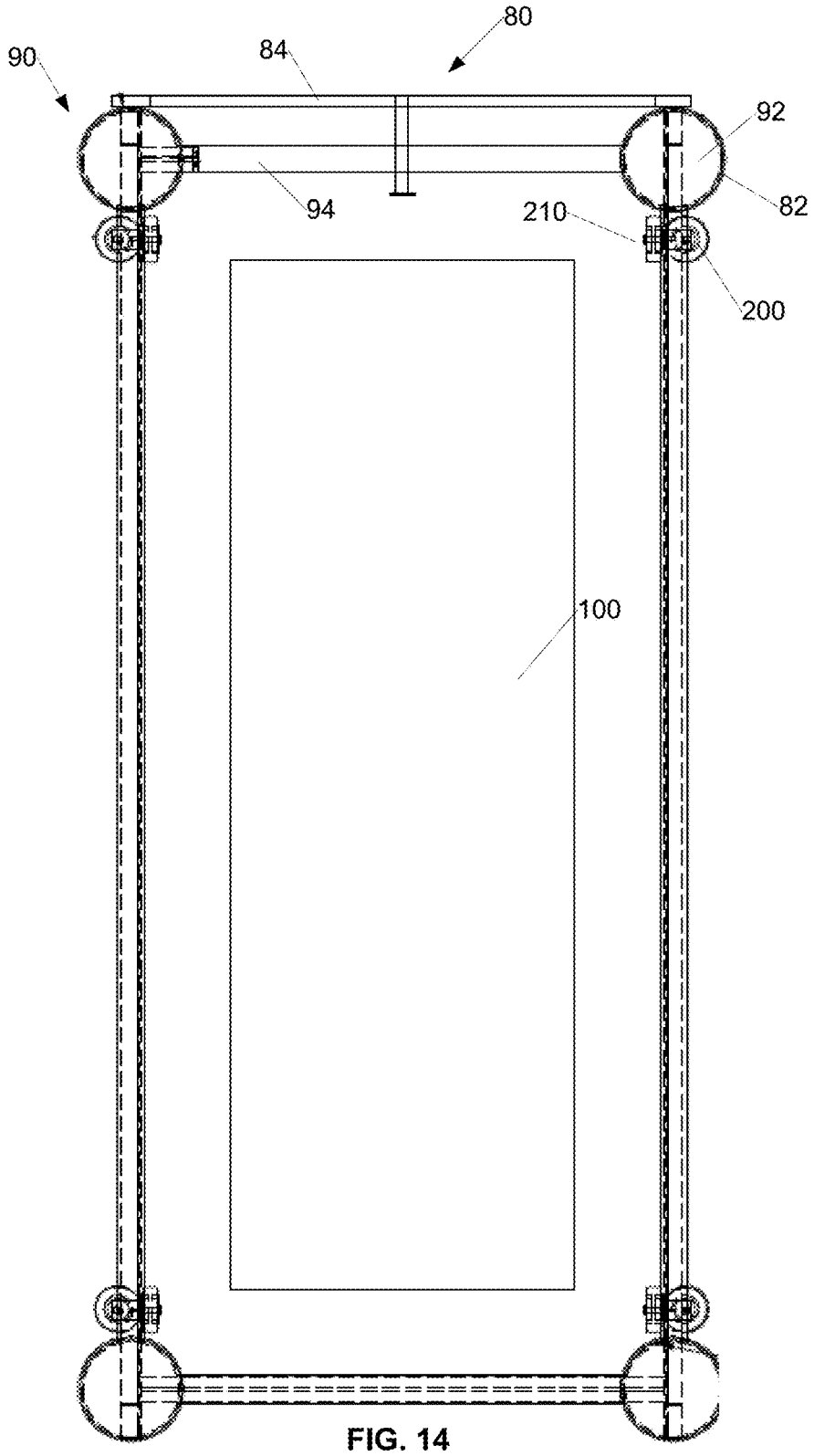
FIG. 14 is a top view diagram illustrating an example carriage supporting a lowering device according to an embodiment of the invention.

FIG. 14 is a top view diagram illustrating an example carriage 80 supporting a lowering device 90 and a casket 100 according to an embodiment of the invention. In the illustrated embodiment, the carriage 80 comprises four corner supports 82 that are connected by four cross members 84 and the carriage 80 also includes four sets of casters, where each set includes a horizontal caster 200 and a vertical caster 210. The carriage 80 is configured to support the lowering device 90 that comprises four corner posts 92 that are connected by four cross bars 94. In one embodiment, movement of the carriage 80 along the rail system may be manually powered. In an alternative embodiment, movement of the carriage 80 along the rail system may be powered by a motor that is configured to propel the carriage 80 along the rail system from under the housing 20 toward the gravesite or from the gravesite toward the housing 20.

Figure 15:
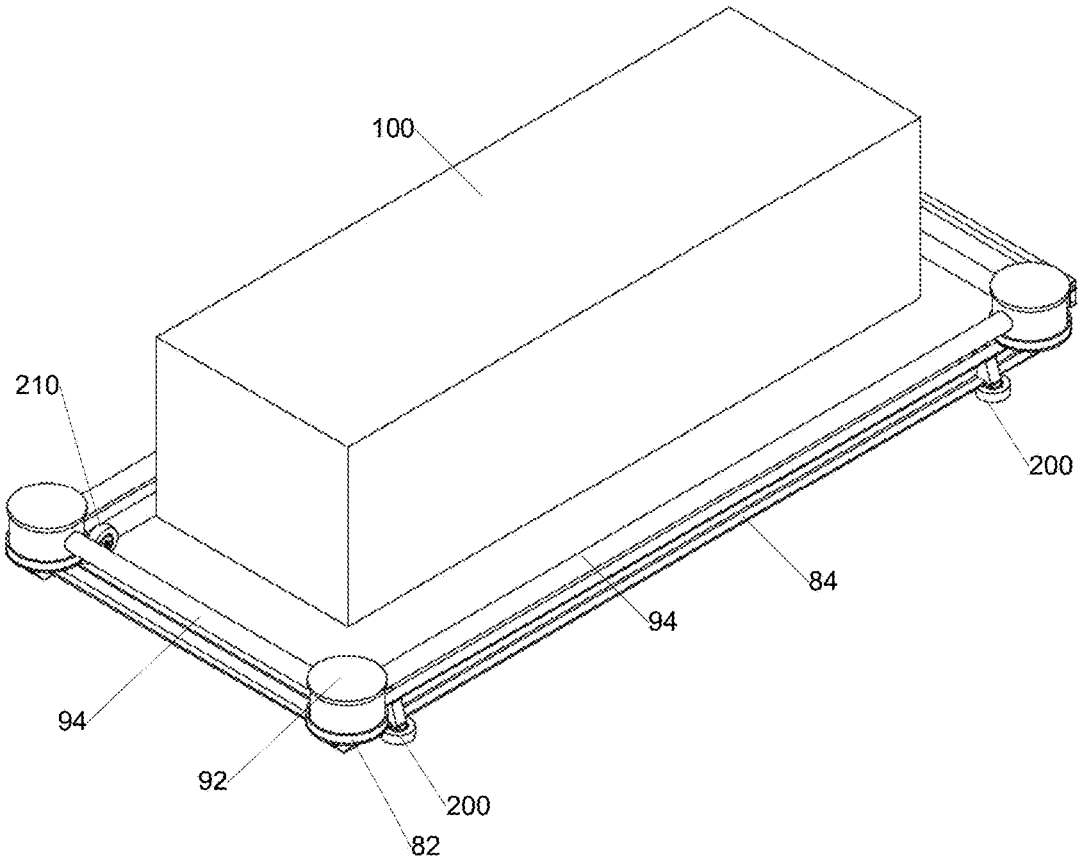
FIG. 15 is a perspective view diagram illustrating an example carriage supporting a lowering device according to an embodiment of the invention.

FIG. 15 is a perspective view diagram illustrating an example carriage 80 supporting a lowering device 90 and a casket 100 according to an embodiment of the invention. In the illustrated embodiment, the carriage 80 comprises four corner supports 82 that are connected by four cross members 84 and the carriage 80 also includes four sets of casters, where each set includes a horizontal caster 200 and a vertical caster 210. The carriage 80 is configured to support the lowering device 90 that comprises four corner posts 92 that are connected by four cross bars 94.

Figure 16:
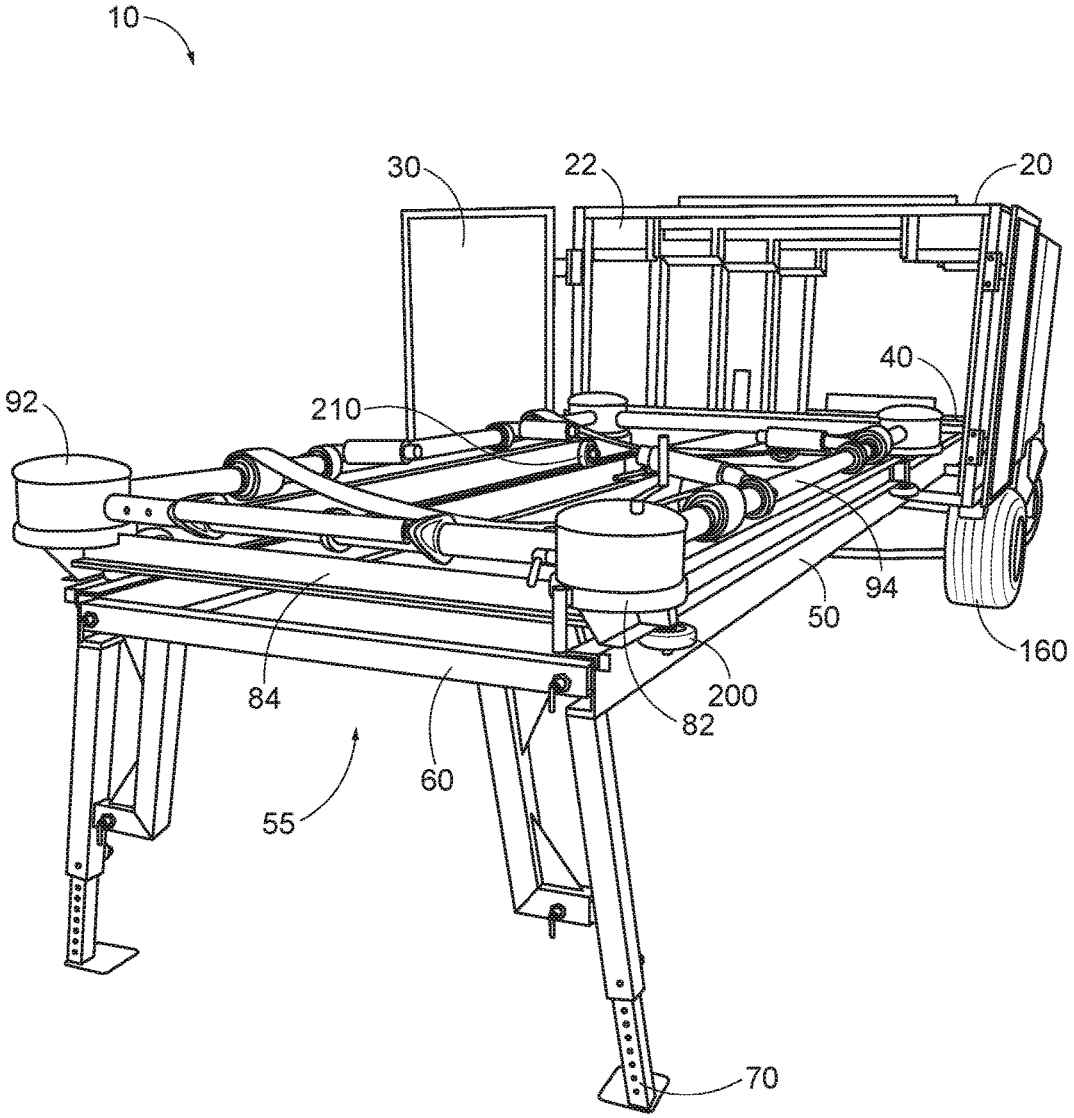
FIG. 16 is a perspective view diagram illustrating an example casket transport and lowering device system according to an embodiment of the invention.

FIG. 16 is a perspective view diagram illustrating an example casket transport and lowering device system 10 according to an embodiment of the invention. In the illustrated embodiment, the system 10 comprises a housing 20 that is attached to a fixed frame 40 that is secured to a transport vehicle 160. The housing includes two doors 30 that swing open to expose the interior of the housing in which the fixed frame 40 is located. The housing 20 defines a storage area 22 that is configured to store the extension rails 50 during transport and any other time that the extension frame 55 is not set up. The extension frame 55 comprises two rails 50 and an extension end 60 that includes two extension feet 70 that are configured for variable length extension.

The extension rails 50 of the extension frame 55 are connected to fixed rails 42 of the fixed frame 40 in a fashion that allows the casters 200, 210 of the carriage 80 to roll the carriage 80 off of the fixed rails 42 of the fixed frame 40 and onto the extension rails 50 of the extension frame 55. The carriage 80 comprises four corner supports 82 that are connected by four cross members 84 to define an opening through which the lowering device 90 can lower the casket 100 into the gravesite. Each corner support 82 of the carriage 80 is configured to support a corner post 92 of the lowering device 90. The corner posts 92 of the lowering device 90 are connected by cross bars 94 such that the corner posts 92 and cross bars 94 also define an opening through which the lowering device 90 can lower the casket 100 into the gravesite.

Advantageously, the system 10 is configured to allow two or fewer personnel to drive the transport vehicle to a location adjacent the gravesite, rotate the fixed frame 40 to align the casket 100 with the gravesite, position the extension rails 50 on each side of the gravesite and position the extension end 60 on the distal end of the gravesite and roll the carriage 80 and its payload comprising the lowering device 90 and the casket 100 over the top of the gravesite. The lowering device 90 is then able to perform its function of lowering the casket 100 into the gravesite.

In one embodiment, the casket transport and lowering device system 10 comprises a vehicle 160 that is configured to transport a casket lowering device system. The vehicle includes a housing 20 that covers at least a portion of the casket lower device system during transport. In this embodiment, the casket lowering device system includes a frame system including a fixed frame 40 portion and an extendable frame 55 portion. The casket lowering device system also includes a carriage 80 that is supported by the frame system. The carriage 80 is configured to support a lowering device 90 that in turn supports a casket 100 (not pictured). Advantageously, the frame system is configured to extend out from the housing 20 to cover a gravesite and the carriage 80 is configured to slide along the frame system to position the lowering device 90 and the casket 100 above the gravesite.

In one embodiment, the frame system further includes a rotating frame member configured to rotate the frame system to align the casket 100 with the gravesite. In one embodiment, the rotating frame member is also configured to rotate the housing 20.

In one embodiment, the fixed frame 40 comprises a first fixed rail and a second fixed rail that are substantially parallel to each other. Advantageously, each of the first fixed rail and the second fixed rail comprises an upper flat surface and an outer flat surface. The upper flat surfaces of the first fixed rail and the second fixed rail are each in a first plane and the outer flat surfaces of the first fixed rail and the second fixed rail face substantially opposite directions. The planar relationship of the upper flat surfaces of the first fixed rail and the second fixed rail allows the carriage 80 to roll along the upper flat surfaces.

In one embodiment, the extendable frame 55 comprises a first extension rail 50 and a second extension rail 50 that are substantially parallel to each other. In this embodiment, each of the first extension rail 50 and the second extension rail 50 comprises an upper flat surface and an outer flat surface. The upper flat surfaces of the first extension rail 50 and the second extension rail 50 are each in the first plane. Additionally, the outer flat surface of the first extension rail 50 is in a same plane as the outer flat surface of the first fixed rail and the outer flat surface of the second extension rail 50 is in a same plane as the outer flat surface of the second fixed rail.

In one embodiment, the extendable frame 55 may further include an extension end 60 connected to a distal end of the first extension rail 50 and connected to a distal end of the second extension rail 50.

In one embodiment, the extension end 60 may include one or more extension feet 70 configured to extend downward a variable length to support the first and second extension rails 50. This is an alternate embodiment to an embodiment where the first and second extension rails 50 cantilever out from the housing 20.

In one embodiment, the carriage 80 further comprises a plurality of platforms 82 connected to each other by a plurality of cross members 84 to define an opening through which the casket 100 may be lowered into the gravesite. In this embodiment, the plurality of platforms 82 are configured to support the lowering device 90.

In one embodiment, the carriage 80 further comprises a plurality of vertical casters 210 configured to engage the upper surface of the first fixed rail, the upper surface of the second fixed rail, the upper surface of the first extension rail 50 and the upper surface of the second extension rail 50. In this embodiment, the plurality of vertical casters 210 are configured to support the carriage 80 on the frame system and allow the carriage 80 to roll along the frame system.

In one embodiment, the carriage 80 further comprises a plurality of horizontal casters 200 including at least a first horizontal caster 200 configured to engage the outer surface of the first fixed rail and the first extension rail 50 and including at least a second horizontal caster 200 configured to engage the outer surface of the second fixed rail and the second extension rail 50. In this embodiment, the first and second horizontal casters 200 are configured to guide the carriage 80 when the carriage rolls along the frame system.

In one embodiment, a method for lowering a casket 100 into a grave includes using a vehicle 160 to transport a casket lowering device system supporting a lowering device 90 that in turn supports the casket 100 to a location proximal a grave. Advantageously, the transport vehicle 160 includes a housing 20 that covers at least a portion of the casket lowering device system, the lowering device 90 and the casket 100 during transport. In this embodiment, the method includes using a rotating frame member of the casket lowering device system to align the casket lowering device system with the grave after the transport vehicle 160 is proximal the grave. The method also includes extending a rail system of the casket lowering device system out over the grave and moving a carriage 80 of the casket lowering device system along the rail system to position the carriage 80 over the grave. The carriage 80 supports the lowering device 90 upon which the casket 100 is supported. The method also includes using the lowering device 90 to lower the casket 100 into the grave.

In one embodiment, extending the rail system also includes attaching a first extension rail 50 to a first fixed rail, attaching a second extension rail 50 to a second fixed rail, extending a first variable length foot 70 to engage a ground surface, and extending a second variable length foot 70 to engage a ground surface. In this embodiment, the first and second variable length feet 70 support the first and second extension rails 50.

In one embodiment, moving the carriage 80 along the rail system comprises rolling the carriage 80 from a first portion of the rail system that is at least partially covered by the housing 20 to a second portion of the rail system that is positioned over the grave and is not covered by the housing 20.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly not limited.

What is claimed is:

1. A method for lowering a casket into a grave comprising:

using a vehicle to transport a casket lowering device system supporting a lowering device that in turn supports a casket to a location proximal a grave, the vehicle comprising a housing that covers at least a portion of the casket lowering device system, the lowering device and the casket during transport;

using a rotating frame member of the casket lowering device system to align the casket lowering device system with the grave;

extending a rail system of the casket lowering device system over the grave by:

attaching a first extension rail to a first fixed rail;

attaching a second extension rail to a second fixed rail;

extending a first variable length foot to engage a ground surface; and extending a second variable length foot to engage a ground surface, wherein the first and second variable length feet support the first and second extension rails;

moving a carriage of the casket lowering device system that supports the lowering device along the rail system to position the carriage over the grave; and using the lowering device to lower the casket into the grave.

2. The method of claim 1, wherein moving the carriage along the rail system comprises rolling the carriage from a first portion of the rail system that is at least partially covered by the housing to a second portion of the rail system that is positioned over the grave and is not covered by the housing.

3. The method of claim 1, wherein rolling the carriage along the rail system comprises rolling a plurality of vertical casters connected to the carriage along the rail system.

4. The method of claim 3, wherein rolling the carriage along the rail system comprises rolling the vertical casters along an upper surface of the rail system.

5. The method of claim 1, wherein rolling the carriage along the rail system comprises rolling a plurality of horizontal casters connected to the carriage along the rail system.

6. The method of claim 5, wherein rolling the carriage along the rail system comprises rolling the horizontal casters along an outer surface of the rail system.

7. The method of claim 1, wherein rolling the carriage along the rail system comprises rolling a plurality of vertical casters connected to the carriage along the rail system and rolling a plurality of horizontal casters connected to the carriage along the rail system.

8. The method of claim 7, wherein rolling the carriage along the rail system comprises rolling the vertical casters along an upper surface of the rail system and rolling the horizontal casters along an outer surface of the rail system.

9. The method of claim 8, wherein rolling the vertical casters along an upper surface of the rail system comprises supporting the carriage.

10. The method of claim 8, wherein rolling the horizontal casters along an outer surface of the rail system comprises guiding the carriage.

11. The method of claim 1, wherein moving the carriage along the rail system comprises sliding the carriage from a first portion of the rail system that is at least partially covered by the housing to a second portion of the rail system that is positioned over the grave and is not covered by the housing.

12. The method of claim 1, wherein aligning the casket lowering device system with the grave comprises aligning a first side of the rail system with a first long edge of the grave and aligning a second side of the rail system with a second long edge of the grave.

13. The method of claim 1, further comprising attaching an extension end to the first extension rail.

14. The method of claim 13, wherein extending the first and second variable length feet comprise extending the first and second variable length feet from the extension end.

15. The method of claim 1, further comprising attaching an extension end to the second extension rail.

16. The method of claim 15, wherein extending the first and second variable length feet comprise extending the first and second variable length feet from the extension end.

17. The method of claim 1, further comprising attaching an extension end to the first extension rail and the second extension rail.

18. The method of claim 15, wherein extending the first and second variable length feet comprise extending the first and second variable length feet from the extension end.

19. The method of claim 1, wherein lowering the casket into the grave comprises lowering the casket through an opening in the carriage.

20. The method of claim 1, wherein using a vehicle to transport a casket lowering device system supporting a lowering device comprises transporting an extension end on an external surface of the vehicle housing.

* * * * *